US005520814A

United States Patent [19]

Celi

[11] Patent Number: 5,520,814

[45] Date of Patent: May 28, 1996

[54] PROCESS FOR RECOVERING SPENT METAL ETCHING SOLUTIONS

[75] Inventor: Antonio M. Celi, Frosinone, Italy

[73] Assignee: In.Tec. Italia International Environment Technology S.r.l., Frosinone, Italy

[21] Appl. No.: 521,280

[22] Filed: Aug. 30, 1995

Related U.S. Application Data

[63] Continuation of Ser. No. 290,497, Aug. 15, 1994, abandoned.

[30] Foreign Application Priority Data

Aug. 13, 1993 [IT] Italy ..... RM93A0558

[51] Int. Cl.[6] ..... C02F 1/26; C02F 1/28

[52] U.S. Cl. ..... 210/638; 210/639; 423/34

[58] Field of Search ..... 210/638, 639, 210/634; 423/34

[56] References Cited

U.S. PATENT DOCUMENTS

| | | | |
|---|---|---|---|
| 3,224,873 | 12/1965 | Swanson | 75/101 |
| 3,440,036 | 4/1969 | Spinney | 75/117 |
| 3,761,249 | 9/1973 | Ritcey et al. | 75/101 |
| 4,083,758 | 3/1978 | Hamby et al. | 204/106 |
| 4,272,492 | 6/1981 | Jensen | 423/24 |
| 4,329,210 | 5/1982 | Merchant et al. | 204/107 |
| 4,350,667 | 9/1982 | Andersson et al. | 423/24 |

OTHER PUBLICATIONS

Tsukada Noriaki et al., JP–A–55 091 979 Patent Abstracts of Japan, vol. 4, No. 144 (C–27) (626) Oct. 11, 1980, Abstract.

Saburou Ikeda, JP–A–55 145 177, Patent Abstracts of Japan, vol. 5, No. 16 (C–41) (688) Jan. 30, 1981, Abstract.

*Primary Examiner*—Cynthia L. Nessler

*Attorney, Agent, or Firm*—Young & Thompson

[57] ABSTRACT

A process comprising spent metal etching solutions, the process comprising the steps of: 1) extracting the metal ions from the spent etching solution by means of a liquid ion exchanger; 2) washing the liquid ion exchanger by means of water; 3) vaporizing the washing water; 4) crystallizing the concentrate after vaporization; 5) filtering the regenerated etching solution; 6) restoring the quality of the etching solution; 7) reextracting the metal from the metal-loaded ion exchanger; 8) washing the liquid ion exchanger; 9) neutralizing the washing water; 10) filtering after carrying out the neutralization; and 11) recovering metal electrolytically.

1 Claim, 5 Drawing Sheets

PROCESS FOR RECOVERING SPENT METAL ETCHING SOLUTIONS

This application is a continuation of application Ser. No. 08/290,497, filed Aug. 15, 1994, now abandoned.

TECHNICAL FIELD

This invention relates to a process for recovering spent or exhausted metal etching solutions.

BACKGROUND OF THE INVENTION

As is well known, in metal etching industry they often have resort to chemical etching processes.

For instance, this is the case with electronic industry in the production of printed circuit boards. In an etching machine or line an active etching solution comprising ammonium chloride and small percentages of other chemical agents is introduced into suitable continuous baths, in which solution duroplast/copper assemblies are dipped, whose portion made up of the thin copper sheet provided on them is removed from the same through selective etching resulting from chemical attack carried out by the solution, so as to obtain the formation of conductive paths according to a previously established topography, i.e. electric circuits.

The active etching solution, after removing a portion of copper from the duroplast, that is the support, leaves the last bath of the etching machine or line as a "spent" solution, i.e. as a copper-containing solution, its concentration being up to 150 g of copper/liter, as cupric chloride, that is as a very poisonous solution.

It is fully evident that it is necessary to recover both chemical agents and the metal or metals contained in such spent solutions. Total recovery is not only an economic factor, but it is mainly an ecological necessity. Such recovery satisfies the requisites of avoiding dispersion of such poisonous solutions into the environment, and of safeguarding metal resources as well, which surely are not endless.

Up to the present time the subject solutions, when not dispersed into the environment, have been treated according to the so-called "knock-down process". The spent solution is mixed with soda in the amount which is considered necessary. Ammonia evolves from the solution (which ammonia can be recovered). Copper or any other metal is "recovered" as the hydroxide, that is in an extremely degraded state, and a liquid made up of sodium chloride contaminated with ammonia and copper is left behind, said liquid being conveyed into a sewer or into a river. Such procedure also turns out to be detrimental to the environment.

Another process already known is the subject of a patent of the same Applicant as that of the present application. However, such process is very complicated and costly to realize, as well as very complex as regards the treatment, and unsuitable to "miniaturization".

OBJECTS OF THE INVENTION

It is an object of the present invention that of providing a process for recovering spent metal etching solutions, which process allows the metal contained in spent solutions to be substantially completely recovered: and which is substantially cheaper than those available at present and is not detrimental to the environment.

Such object is attained by means of a process which is based on the extraction of metal ions from the spent solution through ion exchangers, in particular oximes which are free from aromatic compounds and are in the fluid state, said exchangers having the property absorbing metal ions in exchange for hydrogen ions.

SUBJECT OF THE INVENTION

Accordingly, this invention relates to a process for recovering spent metal etching solutions, said process comprising the steps of:

1) extracting metal ions from the spent etching solution by means of an ion exchanger;
2) washing the liquid ion exchanger by means of water;
3) vaporizing the washing waters;
4) crystallizing the concentrate after vaporization;
5) filtering the regenerated etching solution;
6) restoring the quality of the etching solution;
7) reextracting the metal from the metal-loaded ion exchanger;
8) washing the ion-exchanger liquid;
9) neutralizing the washing waters;
10) filtering after neutralization, and
11) recovering metals electrolytically.

According to a preferred embodiment of this invention, aromatic compounds-free oximes are employed as the ion exchanger.

BRIEF DESCRIPTION OF THE DRAWINGS

This invention will be better understood on the basis of the following detailed disclosure, with reference to the enclosed drawings, wherein.

DETAILED DESCRIPTION OF THE INVENTION

In the following, the treatment according to the teaching of the present invention of the etching solution which is prevalently employed in electronic industry for manufacturing printed circuits is disclosed.

The steps of the process are:

Extraction

Washing of the ion exchanger by means of water

Vaporization of the washing water

Crystallization of the concentrate after vaporization

Filtering of the regenerated etching solution

Restoration of the quality of the etching solution

Reextraction

Washing of the ion-exchange liquid

Neutralization of the washing water

Filtering after neutralization

Recovery of metals through electrolytic processes.

1. Extraction step

Figure 1:
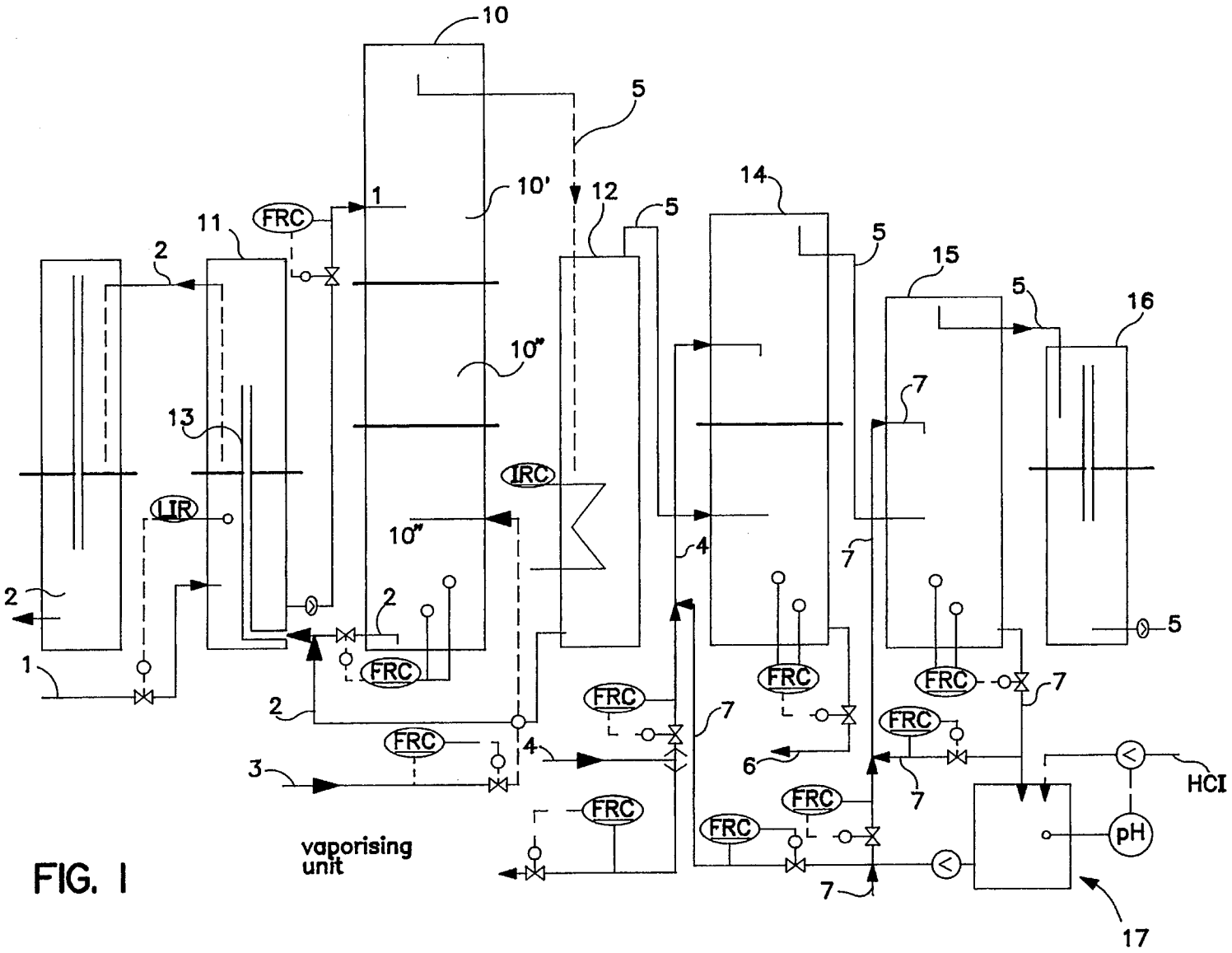
FIG. 1 is a block diagram of the extraction and washing process.

In a vertical tower 10 generally of cylindrical shape, as can be seen in FIG. 1, the ion exchanger 3 introduced into the bottom of the tower, and the spent of exhausted etching solution 1, introduced at the top of the tower 10 are mixed by means of suitable stirrers, all that being carried out continuously and so as to obtain a good intimate mixing. The tower is made up of a number of sections; a section designed to the separation of the liquids follows the section designed for the mixing operation. The ion exchanger 3, which is lighter than the etching solution 1, goes towards the top of the tower 10, whereas the etching solution 1 goes towards the bottom. The separation section contains "Raschig" rings in order to improve the separation process. Then a counter-current extraction is carried out which is based on the density difference between the solution and the ion exchanger. The sequences of mixing/separation events are more than one, in a way that depends on the amount of the liquids introduced into the tower as well as on the surface/volume ratio of the tower itself. Anyway, such sequences must be in such a number as to ensure an almost total exchange (down to a few milligrams) of the metal ions of the spent or exhausted etching solution to the ion exchanger. "Coalescence diaphragms" are present at the top of the tower, where the ion exchanger collects, below the connection for the discharge of the same, and in the bottom portion of the tower where the etching solution which is now free from metals collects, above the connection for the discharge of the same. Such diaphragms cause the liquid particles suspended in the other liquid because they are of very tiny size thus hindered in their motion by the molecular forces of the liquid that contains them, to meet when they pass across such diaphragm and to add to one another together so as to attain size and weight that allow them to follow their proper path towards the top or towards the bottom of the tower.

From the outlet connections of the tower 10, at the bottom for the regenerated etching solution whose flow is pointed out with the reference numeral 2, and at the top for the ion exchanger which is now loaded with metals, whose flow is pointed out with the reference numeral 5, the two liquids are conveyed into successive respective vertical cylinders or towers 11 for coalescence, which in their bottom portion perform the function of storage reservoirs and of heat exchangers. They also perform the function of keeping the level in the extraction tower 10 and allow a space saving in the horizontal direction to be realized. In such "coalescence vertical cylinders" the almost total separation of the two liquids occurs. The portion of ion exchanger within the coalescence cylinder of the etching solution will collect in the top part of the same, in the same way as the portion of the etching solution within the coalescence cylinder of the ion exchanger 12 will collect in the lower part of the same. Measuring electrodes suitably prearranged, through control by means of respective electric valves, provide for removal of unsuitable liquids at any time this is necessary. From this point they are conveyed into the circuit or the reservoir designed for them. The etching liquid or solution 2 which is now almost free from the ion-exchange liquid is conveyed to a vertical cylindrical activated charcoal filter 13 in whose lower portion a reservoir is obtained for storing the etching solution, where such solution which is now totally free from the ion-exchange liquid flows. From here, the regenerated etching solution 2 goes to a "must be/is" control unit, and at that unit it is integrated with the chemical agents it lacks (small amounts lost during employment and during regeneration). After that, the solution is ready for reemployment. The ion exchanger 5, which now contains metals, at the outlet of the coalescence cylinder 12, in a heat exchanger arranged above said cylinder, is heated up to the temperature necessary for the successive steps of the process.

2. The washing step of the ion exchange liquid

This step is carried out within two towers 14 and 15, in the first of which the operation is performed in two washing/separation successions, whereas in the second tower just one succession is enough.

It is necessary to heat the ion-exchange liquid up to a predetermined temperature before carrying out the washing operations, because the density difference and then the weight difference of the two liquids at almost equal temperatures is not of such a value as to ensure separation within the time and according to the way necessary for a good realization of the process as a whole. The first washing aims to free the ion exchanger from any possible small amounts of the etching solution which are present in the same and from ammonia amounts inevitably absorbed by the same during extraction. In order to make this task easier, a very small amount of hydrochloric acid is added to the washing water 4 coming from a condenser upstream of a vaporizing unit, and said hydrochloric acid binds ammonia before the latter is absorbed by the exchange liquid. Upstream of the washing point, water contains ammonium chloride, even though at a very small percentage. Removal both of ammonia and of the very small amounts of solution of the extraction liquid is a requisite of the last step of the process, the electrolytic recovery of metals.

The ion exchanger 5 with its load of metals but free now from ammonia and containing ammonium chloride even though in very small amounts and largely diluted as yet, is conveyed to the second washing tower 15, which operates with one only sequence of washing/separation operation; here the exchanger is further washed with water 7 coming from the condenser, that is with distilled water. From here, the exchanger flows into a suitable coalescence cylinder or tower 16 wherein it will lose the washing water particles from which it had not been freed before, and then it flows into the storage reservoir arranged below said coalescence cylinder. A suitable pump will provide for conveying the exchanger to the successive process steps.

3. Vaporization of the washing water

Water, both that from the first and that from the second washing step, is conveyed to the vaporizing unit or distillation column (not shown). Such column which is made up of glass and supplied with a heat exchanger which can stand the aggression of chemical agents (as it is made up of graphite blocks or of tantalium pipes), is of such size as to be capable of exhausting with relative safety margin, all washing water which is necessary for the process and is endowed in its top intermediate portion with a Raschig ring packing so as to cause any possible chemical agent vapors to condense. The water vapor condenser also operates in its highest portion as a heat recoverer, and washing water is to be conveyed there before vaporizing the same. Into such water, before it is conveyed into the vaporization circuit, hydrochloric acid 17 is metered in the necessary amount so that the content can be crystallized as ammonium chloride, in order to avoid the vaporization of ammonia which is no longer condensable by means of the Raschig ring packing.

In the lowest part of the vaporization circuit the concentrate collects, which is then conveyed continuously to the crystallizer by means of a metering pump.

4. Crystallization of the concentrate

In a vertical pipe of suitable diameter and of length proportional to the same, in the inside part of which pipe a suitable number of fins of suitable sizes are fixed along its full length, a shaft rotates alternately and concentrically, said shaft being provided with brushes arranged according to a spiral pattern which concern the whole area of the pipe itself till sliding on the inside part of the same. The upper part of the pipe is connected to an exhaust fan. In that part some sprayers of the concentrate are also arranged so as to concern the whole area of the pipe. The concentrate is sprayed continuously on the brushes. The spirally arranged brushes in their alternate rotation motion against the pipe fins spread the concentrate throughout the whole volume of the pipe. The concentrate so becomes crystallized in all the possible amount as a result of the cold environment generated by air from a cold source which goes continuously through the inside of the pipe. In a collection tub arranged at the lower end of the pipe, there is just a small amount of diluted solution which is to be sent again to the vaporization unit, in addition to the salts formed which will be conveyed by means of a screw conveyer to the regenerated etching solution for being mixed again.

5. Filtering of the regenerated etching solution

The regenerated etching solution 2, as already observed previously, is conveyed into an activated charcoal filter and there it leaves behind also any possible parts of the liquid exchanger and of its diluting compound which had been absorbed.

6. Restoration of the quality of the etching solution

To the regenerated etching solution first of all the ammonium chloride obtained in the crystallizer is mixed, then its state "is" controlled and to the same is now added what is lacking, in particular gaseous ammonia and some other chemical agents in small amounts, after having attained the "must be" state after a further conventional filtering, and the solution is ready for being reemployed in the same conditions as before.

7. Reextraction

Figure 2:
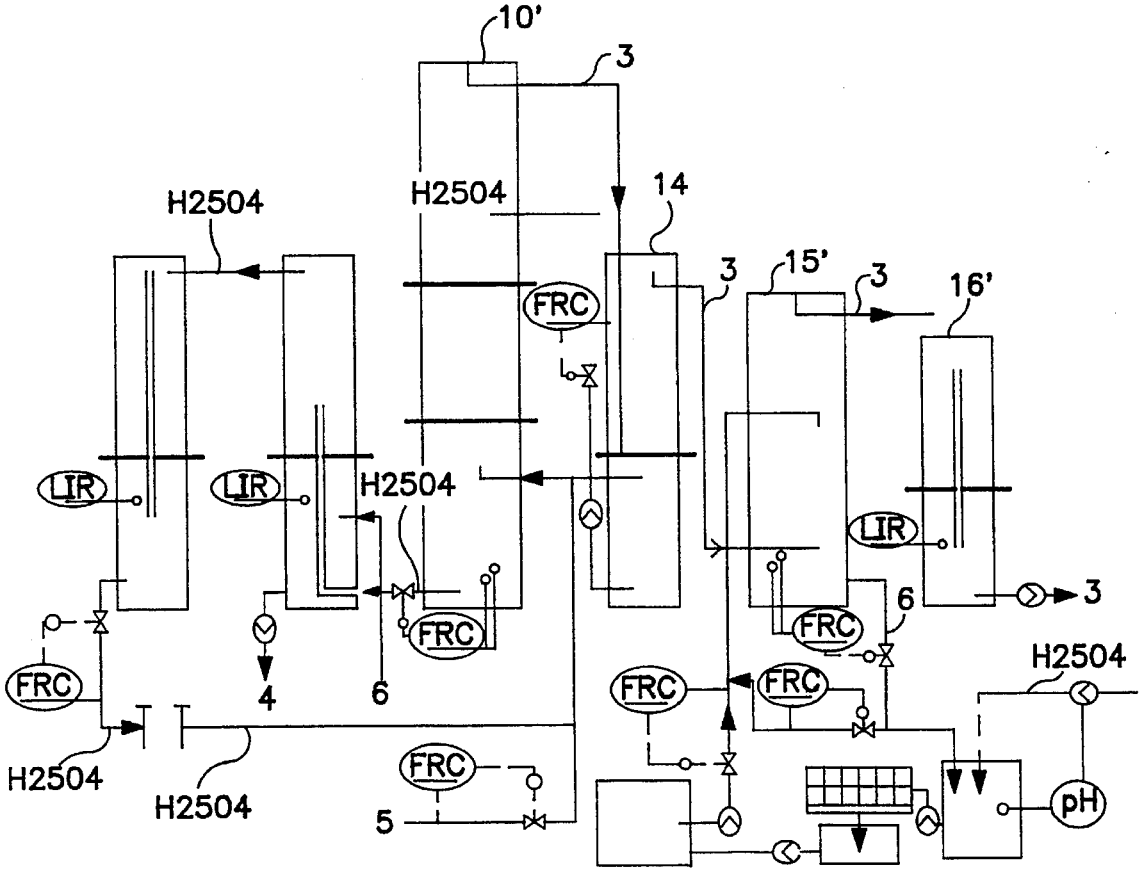
FIG. 2 is a block diagram of the reextraction and washing process.

This process is identical with the extraction process. With reference to FIG. 2, the reextraction tower 10' is identical to the extraction tower 10 of FIG. 1. It also is provided with coalescence diaphragms. In said tower, instead of obtaining an intimate mixture of the etching solution containing the metal and of the ion-exchange liquid, an intimate mixture is obtained of a solution which is ready to absorb a metal and of the ion-exchange liquid loaded with metal 5. Sulfuric acid 7 is mixed with the ion-exchange liquid loaded with metal 5 so as to obtain copper sulfate at a concentration which is the most suitable for the successive metal recovery step. Thus the ion-exchange liquid is regenerated, which at the outlet of the reextraction tower flows, just like in the extraction process, into a coalescence cylinder 14 and from there into a washing tower 15.

8. Washing of the ion-exchange liquid

This operation which is generally carried out with two washing/separation successions, is identical with that carried out in the washing tower after extraction. The liquid exchanger which is now free from metals, is cleaned here from the small amounts of sulfuric acid/copper sulfate which are present in the same, and from here again in a coalescence cylinder 16, then in a storage tub from which it is conveyed again to the extraction tower by means of suitable pumping. The washing water which now contains sulfuric acid/copper sulfate is now neutralized.

9. Neutralization of the washing water containing sulfuric acid/metal sulfate

In a stirred tub some lime milk is prepared and then conveyed by means of a metering pump to a successive stirred tub in which also the washing water to be neutralized flows continuously. Here the lime milk absorbs the sulfates present in the washing water, so that calcium sulfate is formed. Water, which is now free from sulfates but contains calcium sulfate in suspension, is conveyed to a filtering unit.

10. Filtering after neutralization

The filtering apparatus can be of the continuous conduction type, in that case will be a tape filter under vacuum, or such apparatus can be of the discontinuous conduction type, and hence acting by means of a multi-chamber press. From the filtering apparatus the neutralized water which is now free from calcium sulfate goes back partly to the washing tower and partly to the preparation of the lime milk.

11. Recovery of metals by means of electrolysis

A sequence of rectangular tubs of sizes, total volume and number suitable to the amount of metal to be recovered are fed in parallel with copper sulfate coming from the last process step of the reextraction line. Copper sulfate is conveyed to said tubs from an intermediate storage reservoir by means of a suitable throughput and operating pressure pump. The introduction into said tubs is performed at one of their longest size by means of distribution pipes which cause the whole liquid mass in the tub to be never in a stagnation state. The flow of the liquid, which now has become again sulfuric acid occurs from the long side opposite to the introduction side is directed towards a storage tank and from there to the reextraction tower. The system itself for such removal flow supplies the way to control and adjust the electrolysis liquid level in the tubs. Again along the long sides the power conductive profiles are arranged, such profiles forming series connection groups and being in turn parallel connected to a low-voltage, high-current generator of direct current, so as to allow the series groups to receive the voltage necessary to each group for the metal to be recovered and to allow the groups as a whole to receive the total voltage necessary to the recovery of the metal amount removed from the etching solution.

Contact bars are arranged transversely to said tubs and are connected to the positive electricity profile and to the negative electricity profile of the opposite side, such profiles being provided with insulating supports and spacing supports, while anodes and cathodes of the electrolytic system are fixed to such bars and are completely dipped in the liquid of the same. A lead alloy plate can be employed as the anode, or an iridium-alloyed titanium grid plate can be better employed—but with a very high initial cost of the plant—while a very thin plate of cathodic copper is sufficient as the cathode, called the matrix plate. Anodes and cathodes are of sizes and at reciprocal spacings suitable to the sizes of the tubs. Cathodes on which the copper recovered will be increasing are to be substituted each time they reach their ideal thickness, i.e. they will be grown in thickness from their initial values of 0.3–0.4 mm up to about 15–18 mm.

The metal, in this specific case being copper, was found to be recovered by means of the process herein disclosed with a purity degree of up to 99.99% , this yield being never attained before.

On the basis disclosed above, it can be concluded that the process disclosed attains the objects of the present invention.

With reference to FIGS. 3–6, the flow diagram of the recovery line of the spent etching solution will be illustrated in the following.

The spent cupric etching solution regeneration plant (reduction of cupric ammonium chloride in ammonium and copper chloride) comprises a stockage group of the solutions and of hydrochloric acid, HCl; an extraction group, a group for washing ammonia, a reextraction group, a group for washing sulfates, a vaporization and crystallization group, an electrolytic bath group, a final mixing group for the regenerated etching solution.

Figure 3:
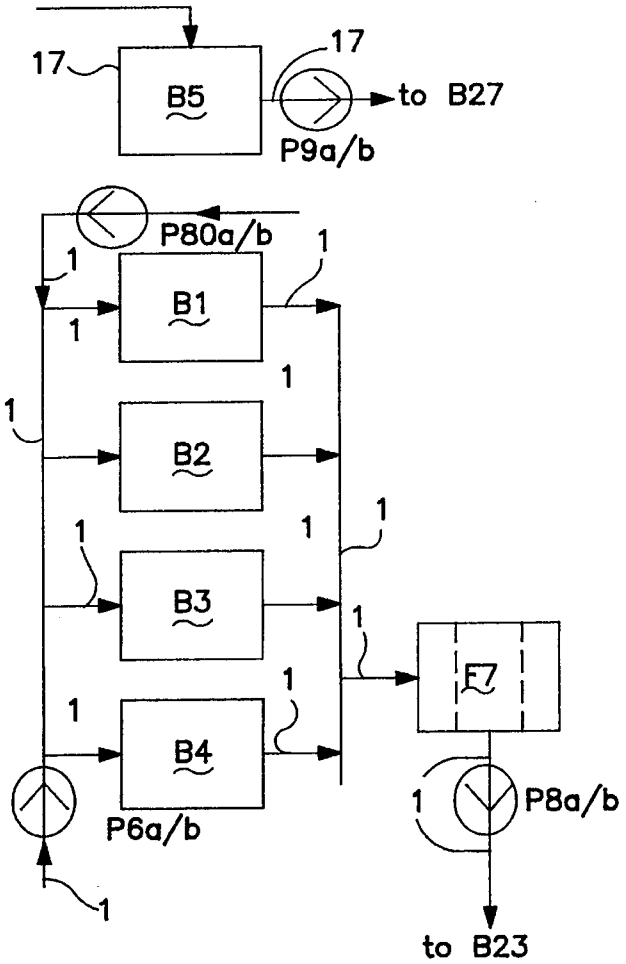

FIG. 3 represents the stockage scheme of the spent solution which is arriving. From a tank truck, hydrochloric acid HCl 17 goes to a vertical cylindrical reservoir for HCl stockage B5 and from there the acid is fed through a membrane metering pump to a reservoir B27.

From some containers of the spent solution by means of a membrane metering pump P80 and from a tank truck the spent solution 1 is distributed into four (4) vertical cylindrical stockage reservoirs B1–B4, and from such reservoirs to a bag filter F7 from which it is then conveyed to a reservoir B23 through a magnetic coupling feed pump P8.

Figure 4:
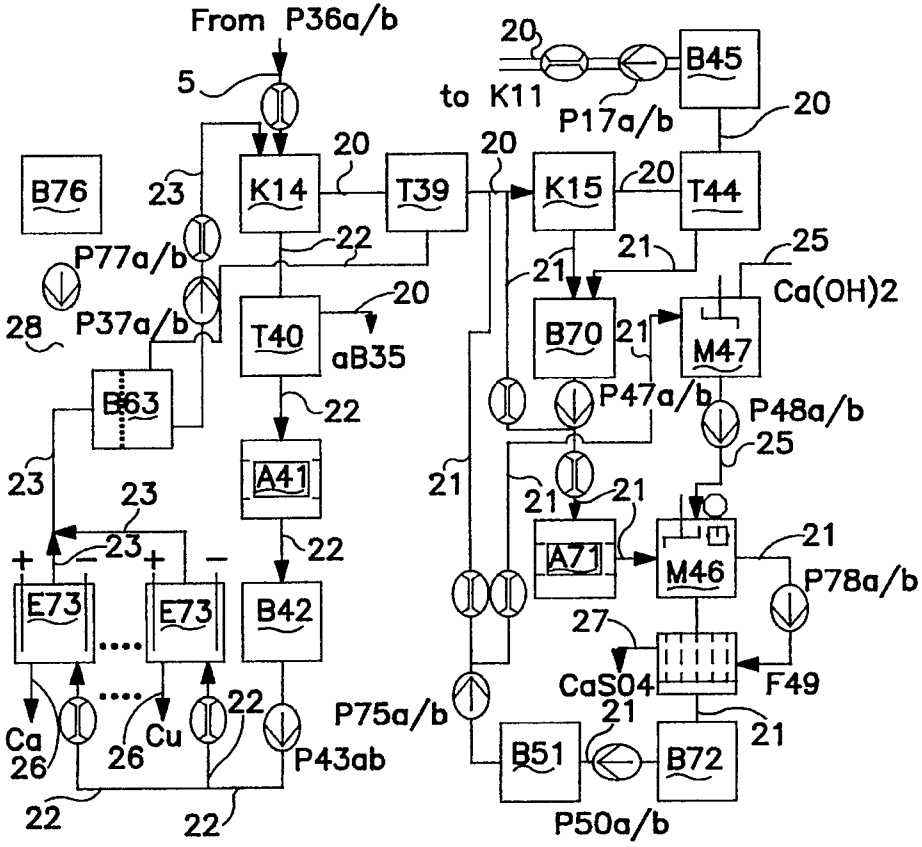
FIGS. 3–6 are flow diagrams of the line for the recovery of the spent etching solution.
Figure 5:
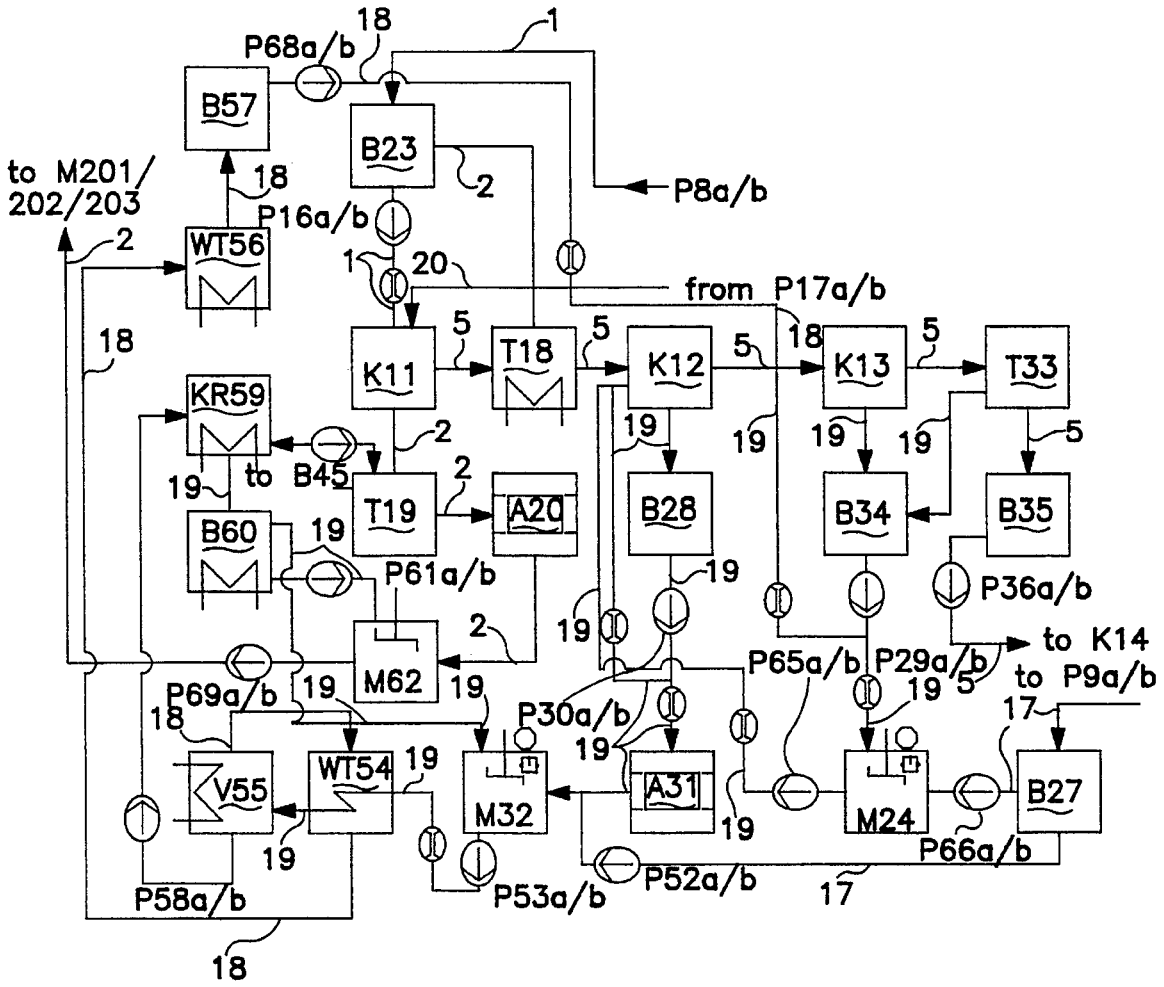
Figure 6:
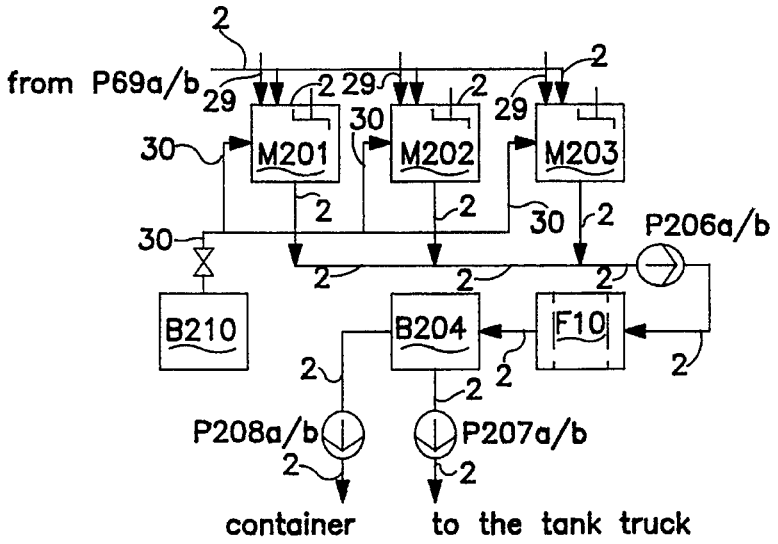

FIGS. 4 through 6 illustrate the scheme of the extraction process, the washing step of the ion exchanger (ammonia), the vaporization and crystallization step.

By means of the feeding pump P8 the spent etching solution goes to a feeding reservoir 23 by means of which it goes, through the magnetic coupling feeding pump P16, to the vertical cylindrical extraction column K11. The metal-lean ion-exchanger 20 from a pump P17 goes to this same column.

At the outlet from the tower K11 there are the regenerated etching solution 2 and the metal-enriched ion exchanger 5. The regenerated solution 2 goes to a coalescence separator T19 which has an outlet where the metal-enriched ion exchanger 5 flows, and then the solution goes to activated charcoal filters A20, then it goes to a mixing tub M62 into whose inlet $NH_4Cl$-containing water flows, and finally the solution goes to three mixing reservoirs M201, M202 and M203.

Turning now the attention again to the tower K11, the metal-enriched ion exchanger 5 goes to a coalescence separator T18, and then to a vertical cylindrical washing column K12, then to another vertical cylindrical washing column K13, to a vertical cylindrical coalescence separator T33, to a vertical cylindrical feeding tub B35 and finally, by means of a magnetic coupling feeding pump P36 to a vertical cylindrical reextraction column K14.

Finally, at the inlet of the process there is hydrochloric acid HCl coming through the pump P9, said acid going into the reservoir B27 and then passing to a mixing tub M24 by means of a pump P66 and according to a parallel flow with an outlet of $NH_4Cl$-containing water 19 from a complex unit made up of two vertical cylindrical activated charcoal filters A31.

The mixing tub M24 has another $NH_4Cl$-containing water inlet, said water coming through a complex unit made up of two magnetic coupling feeding pumps P29 from a vertical cylindrical service tub B34 having two $NH_4Cl$-containing water inlets from the blocks K13 and T33 mentioned above.

The complex unit of pumps P29 conveys the $NH_4Cl$-containing water, even the return water, to the block K13.

The $NH_4Cl$-containing water inlet flow goes to the complex unit of two activated charcoal filters A31 through a complex unit of two feeding pumps **P30*a/b* from a vertical cylindrical service tub B38 which in turn receives the same from the washing column K12, which column receives it at the inlet from the mixing tub M24 through a complex unit of two magnetic coupling feeding pumps P65*a/b***.

The line 19 at the outlet from the complex unit of activated charcoal filters A31 goes into a vertical cylindrical neutralization tub M32. From such tub, the $NH_4Cl$-containing water goes by means of a complex unit of two magnetic coupling feeding pumps **P53*a/b* to a heat exchanger WT54 and from the same to a vaporizing unit V55, and then it goes through a complex unit of two magnetic coupling feeding pumps P58*a/b* to a vertical cylindrical crystallizer KR59 from which said water flows to a cooling tub B60, from which tub two flows go out. one flow being to the mixing tub M62 whereas the other one returns to the neutralization tub M32**.

Into the heat exchanger WT54 a steam flow 18 goes, said steam coming from the vaporizer V55, while another steam flow goes out of said exchanger and into a cooler WT56 from which it goes to a service tub B57 and then to the washing column K13 through a complex unit of two magnetic coupling feeding pumps **P68*a/b***.

With reference to FIG. 5, the scheme of the reextraction washing of the ion exchanger (sulfuric acid) and electrolysis process is illustrated.

The inlets of the process are realized by the complex unit of pumps P36 and by a $Ca(OH)_2$ line.

The first inlet goes into a vertical cylindrical reextraction column K14 at those outlet there is the metal (Cu)-lean ion exchanger 20, which goes to a vertical cylindrical washing column K15 and from such column to a vertical cylindrical coalescence separator T44 and then to a service reservoir B45 from which it finally goes to the extraction column K11 through the complex unit of two magnetic coupling feeding pumps **P17*a/b***.

Moreover, Cu-containing electrolytic liquid goes out of the reextraction column K14 which goes to a vertical cylindrical coalescence separator T40 from which the metal-lean ion exchanger 20 flows and passes to the feeding tub B35, and again Cu-containing electrolytic liquid which goes to a complex unit of two activated charcoal filters A41, from which it flows to a rectangular feeding tub B42, from which tub it goes through a complex unit of two magnetic coupling feeding pumps P43 to a group of fortyfive (45) rectangular electrolyses tubs E73, from which the Cu-lean electrolytic liquid 23 flows going to a rectangular feeding tub B63 from which it goes to the reextraction column K14 through a complex unit of two magnetic coupling feeding pumps **P37*a/b***.

At the outlet of the electrolysis tubs E73 there is also electrolytic copper 26.

96% $H_2SO_4$ 28 also enters the feeding tub B63 through a membrane metering pump member **P77*a/b***.

Cu-containing electrolytic liquid 22 flows out of the coalecence separator T39, such liquid going into the feeding tub B63.

The flow 25 of $Ca(OH)_2$ enters a vertical cylindrical mixing tub M47 and from there passes through a complex unit of two magnetic coupling feeding pumps **P48*a/b* into a vertical cylindrical neutralization tub M46. A flow 21 of washing water goes respectively into this tub and out of the same. The inlet washing water comes from a complex unit of two vertical cylindrical activated charcoal filters A71, to which complex unit it goes through a complex unit of two magnetic coupling feeding pumps P74*a/b* from a service tub B70 which is fed with such washing water from the washing column K15 and from the coalescence separator T44. The pump complex unit P74*a/b* conveys in return the washing water 21 to the washing column K15**.

Turning now the attention to the flow of the washing water 21 coming out of the neutralization tub M46, it goes to a filter press F49 from which both $CaSO_4$ 27 and washing water 21 flow, said washing water going to a square tub collecting reservoir B72 from which it goes through a complex unit of two magnetic coupling feeding pumps B50 to a feeding tub B51 and then returns to the washing column K15 through a complex unit of two magnetic coupling feeding pumps **P75*a/b*, a return path to the mixing tub M47** being provided as an offtake in the return path to said complex unit.

With reference now to FIG. 6, the scheme for the restoration of the quality of the regenerated etching solution is illustrated.

Chemical agents enter the vertical cylindrical mixing reservoirs M201, M202 and M203, into which reservoirs a regenerated etching solution 2 also flows coming from the group of two magnetic coupling feeding pumps P69*a/b*, and ammonia 30 from a group of six (6) ammonia cylinders B210 having convex heads. The regenerated etching solution flows out of the reservoirs M201, M202 and M203 and then goes through a magnetic pump P206 to a plate filter F10 and from said filter to a vertical cylindrical stockage reservoir B204 from which it goes to some containers by means of a magnetic coupling feeding pump P208 and to a tank truck through another magnetic coupling feeding pump P207.

Figure 7:
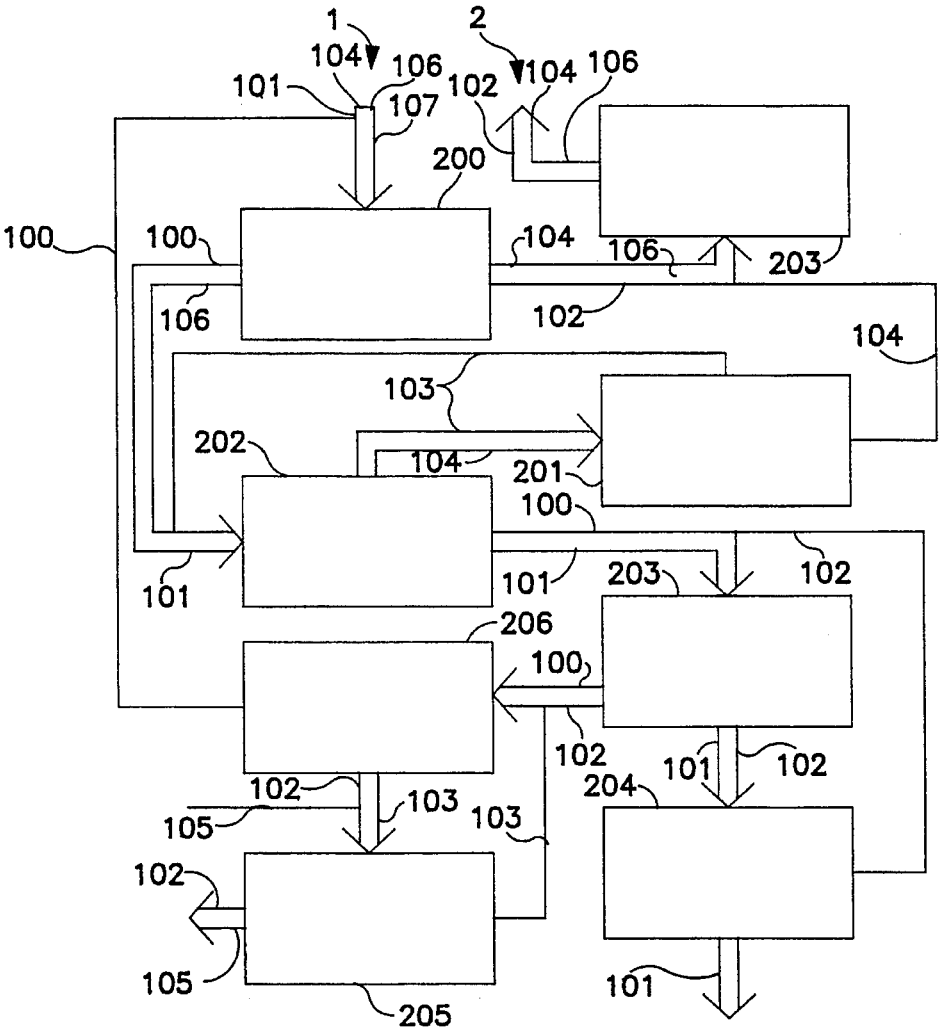
FIG. 7 is a flow diagram of the process.

With reference now to FIG. 7 the flow of the compounds in the process is illustrated.

The spent etching solution 1 with the ion exchanger 100, copper 101, $NH_4Cl$ 104, ammonia 106 and the etching solution 107 enter the extraction block 200. The ion exchanger 100, copper 101 and ammonia 106 flow out of one side of the extraction stage 200. Such compounds together with water 103 flowing out of the vaporization stage 201 enter the stage 202 of washing ammonia from which stage water 103 and $NH_4Cl$ go out, and flow into the vaporization stage 201. From such stage $NH_4Cl$ goes out which together with other $NH_4Cl$, with ammonia $NH_3$ and the etching compound all coming out of the extraction stage 200 flow to a stage 203 for the reproportioning of the ingredients, from which stage the regenerated etching solution containing the etching compound, $NH_4Cl$ and $NH_3$ flows.

From the washing stage 202 the ion exchanger 100 and Cu 101 flow out and enter together with $H_2SO_4$ coming from the electrolysis stage 204 the reextraction stage 203, from which $H_2SO_4$ 102 and copper (Cu) 101 flow on one side and go to the electrolysis stage 204 mentioned above, while from another side the ion exchanger 100, $H_2SO_4$ 102 and water $H_2O$ 103 which comes from the neutralization stage 205 flow out entering the stage 206 where the sulfates are washed, from which stage the ion exchanger 100 that goes to the extraction stage 200 mentioned above and copper 101, $H_2SO_4$ 102 and water 103 which go to the neutralization stage 205 flow out, copper and $H_2SO_4$ going out of said neutralization stage.

From the electrolysis stage 204 copper (Cu) 101 goes out.

This invention has been disclosed with reference to a specific embodiment of the same, but it is to be understood clearly that the details disclosed have been presented just for exemplification purposes in order to illustrate the teaching of the invention, and that additions, changes and/or omissions can be introduced without departing from its protection scope which is defined by the enclosed claims.

I claim:

1. A process for recovering spent copper etching solutions, said process comprising the steps of:

a) extracting copper ions from the spent etching solution with a liquid ion exchanger comprising oximes free of aromatic compounds so as to obtain a copper-loaded ion exchanger and a regenerated etching solution;

b) heating the liquid ion exchanger;

c) washing the heated liquid ion exchanger with water and a small quantity of HCl so as to obtain a wash water;

d) vaporizing the wash water thereby producing a concentrate;

e) crystallizing the concentrate after vaporization;

f) filtering the regenerated etching solution;

g) restoring the quality of the regenerated etching solution by the addition of gaseous ammonia;

h) reextracting copper from the copper-loaded ion exchanger using sulfuric acid;

i) washing the liquid ion exchanger with a washing water;

j) neutralizing the washing water with lime so as to obtain a neutralized washing water;

k) filtering the neutralized washing water; and l) recovering copper electrolytically.

* * * * *